US005212504A

United States Patent [19]

Takada et al.

[11] Patent Number: 5,212,504

[45] Date of Patent: May 18, 1993

[54] IMAGE FORMING APPARATUS EMPLOYING LED PRINTING HEAD

[75] Inventors: Akihiro Takada, Sayama; Akihiro Kondou, Isumi, both of Japan

[73] Assignee: Mita Industrial Co., Ltd., Japan

[21] Appl. No.: 764,766

[22] Filed: Sep. 24, 1991

[30] Foreign Application Priority Data

Oct. 1, 1990 [JP] Japan ..... 2-264868

[51] Int. Cl.[5] ..... G03G 15/06; G03G 21/00

[52] U.S. Cl. ..... 346/160; 355/208; 355/246

[58] Field of Search ..... 355/208, 214, 1, 246; 346/160, 155

[56] References Cited

U.S. PATENT DOCUMENTS

| | | | |
|---|---|---|---|
| 4,239,374 | 12/1980 | Tatsumi et al. | 355/214 |
| 4,717,924 | 1/1988 | Bangs et al. | 346/76 PH |
| 4,799,071 | 1/1989 | Zeise et al. | 346/160 |
| 4,831,395 | 5/1989 | Pham et al. | 346/160 |
| 4,941,004 | 7/1990 | Pham et al. | 346/160 |

*Primary Examiner*—Fred L. Braun

*Attorney, Agent, or Firm*—Beveridge, DeGrandi, Weilacher

[57] ABSTRACT

In an image forming apparatus, a latent image is formed on a photoreceptor by an LED printing head based on image information. The latent image is developed into a toner image by a developing apparatus, to which a developing bias voltage is applied. The developing bias voltage is controlled according to a temperature of the LED printing head sensed by a temperature sensor so that a toner density of a toner image formed by the developing apparatus is appropriate.

6 Claims, 4 Drawing Sheets

IMAGE FORMING APPARATUS EMPLOYING LED PRINTING HEAD

BACKGROUND OF THE INVENTION

1. Field of the Invention

The present invention relates to an image forming apparatus employing an LED (light emitting diode) printing head. More particularly, the present invention relates to an image forming apparatus such as a digital electrophotographic copying machine, a printer, etc.

2. Description of the Prior Art

Digital image forming apparatuses have conventionally been known which have an LED printing head as writing means. Generally, digital image forming apparatuses are provided with a photoreceptor, charging apparatus for forming a charging portion on the photoreceptor, an LED printing head for forming a latent image by irradiating light on the charging portion of the photoreceptor based on image information and a developing apparatus for developing the latent image formed on the photoreceptor into a toner image. A plurality of LEDs are provided in an array on the LED printing head. An exposure energy required for a formation of a latent image is determined by an emission energy and emission duration of the LEDs.

For example, when the toner development is a reversal development where toner adheres to a latent image on a portion on which light is irradiated by the LED printing head, if an original has a lot of black portions or if a copying operation is continuously performed (for example, a continuous copying is performed), the LEDs generate heat since an activation duration for the LEDs increases. An emission energy of the LED which is generally used decreases as temperature increases. Therefore, when the activation duration for the LED increases according to image information, there arises a problem that the exposure energy decreases to reduce an image density so that an image quality deteriorates.

To overcome such a problem, Japanese laid-open Patent Application No. S61-255366 discloses a feature where a temperature of the LED printing head is detected by a temperature sensor and a duty ratio of a light quantity signal of the LED is changed according to a change in the temperature.

Specifically, the duty ratio of the light quantity control signal is controlled so as to increase when a temperature of the LED printing head increases. In this method, however, the activation duration for the LED increases to further increase a temperature of the LED printing head, so that the image quality inevitably deteriorates.

SUMMARY OF THE INVENTION

An object of the present invention is to provide an image forming apparatus where a deterioration of an image quality due to an increase in temperature of an LED head can be prevented.

According to one feature of the present invention, an image forming apparatus is provided with: a photoreceptor; charging means for forming a charged portion on the photoreceptor; an LED printing head, for forming a latent image by irradiating light on the charged portion formed on the photoreceptor based on image information, comprising a plurality of light emitting diodes; developing apparatus for developing the latent image formed on the photoreceptor into a toner image; voltage applying means for applying a developing bias voltage to the developing apparatus; temperature sensing means for sensing a temperature of the LED printing head; and controlling means for changing a developing bias voltage applied to the developing apparatus by the voltage applying means according to a temperature, of the LED printing head, sensed by the temperature sensing means so that a toner density of a toner image formed by the developing apparatus is appropriate.

According to another feature of the present invention, an image forming apparatus is provided with: a photoreceptor; charging means for forming a charged portion on the photoreceptor; pulse voltage supplying means; an LED printing head, for forming a latent image by irradiating light on the charged portion formed on the photoreceptor when a pulse voltage is applied, comprising a plurality of light emitting diodes; a developing apparatus for developing the latent image formed on the photoreceptor into a toner image; voltage applying means for applying a developing bias voltage to the developing apparatus; temperature sensing means for sensing a temperature of the LED printing head; and controlling means for changing a developing bias voltage applied to the developing apparatus by the voltage applying means so that an operation duration of the LED printing head decreases and a toner density of the toner image formed by the developing apparatus improves when a temperature of the LED printing head sensed by the temperature sensing means exceeds a predetermined temperature.

According to the above-described features of the present invention, since the controlling means changes the developing bias voltage to be applied to the developing apparatus, according to the temperature of the LED printing head sensed by the temperature sensing means, so that a toner density of the toner image formed by the developing apparatus is appropriate, a variation in toner density due to a change in temperature of the LED printing head can be prevented.

Further, since the controlling means changes the developing bias voltage to be applied to the developing apparatus so that an operation duration of the LED printing head decreases and a toner density of the toner image formed by the developing apparatus improves when the temperature of the LED printing head sensed by the temperature sensing means exceeds a predetermined temperature, a deterioration of the toner density is prevented as well as a temperature of the LED printing head is decreased.

For example, when the toner development is the reversal development where toner adheres to a latent image of a portion on which light is irradiated by the LED printing head, if the controlling means controls the developing bias voltage so as to change toward the electric potential of the charging portion when the temperature of the LED printing head increases, a decrease in toner density is prevented even if the electric potential of the latent image on the portion on which light is irradiated varies as the temperature of the LED printing head increases.

For example, when the controlling means controls the developing bias voltage so as to change only when the sensed temperature of the LED printing head exceeds a predetermined temperature, an operation duration of the developing bias voltage and that of the LED printing head are maintained constant until the predetermined temperature is exceeded.

BRIEF DESCRIPTION OF THE DRAWINGS

This and other objects and features of this invention will become clear from the following description taken in conjunction with the preferred embodiments with reference to the accompanied drawings in which.

DETAILED DESCRIPTION OF THE PREFERRED EMBODIMENTS

An embodiment of the present invention will hereinafter be described with reference to the drawings.

Figure 1:
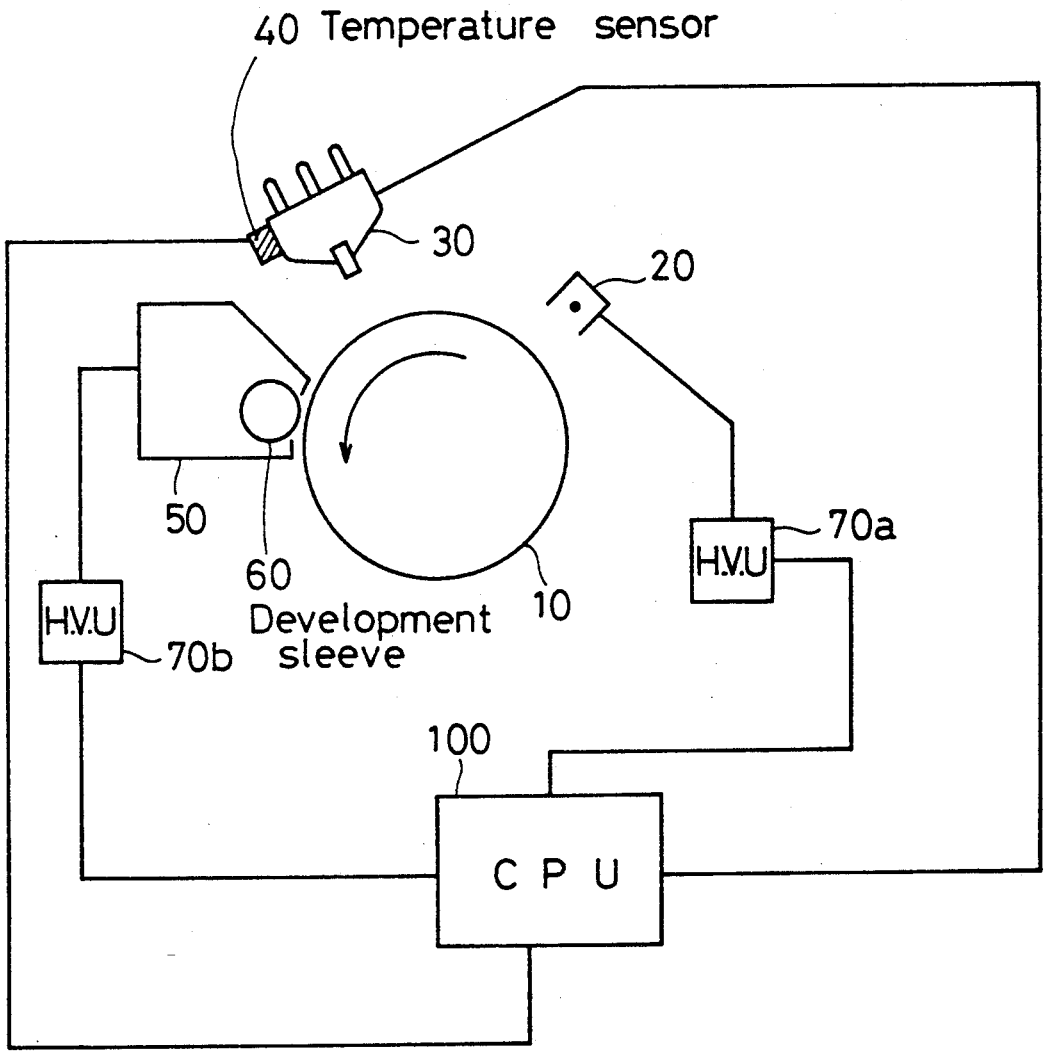
FIG. 1 is a schematic view of a main portion of an embodiment of the present invention.
Figure 2:
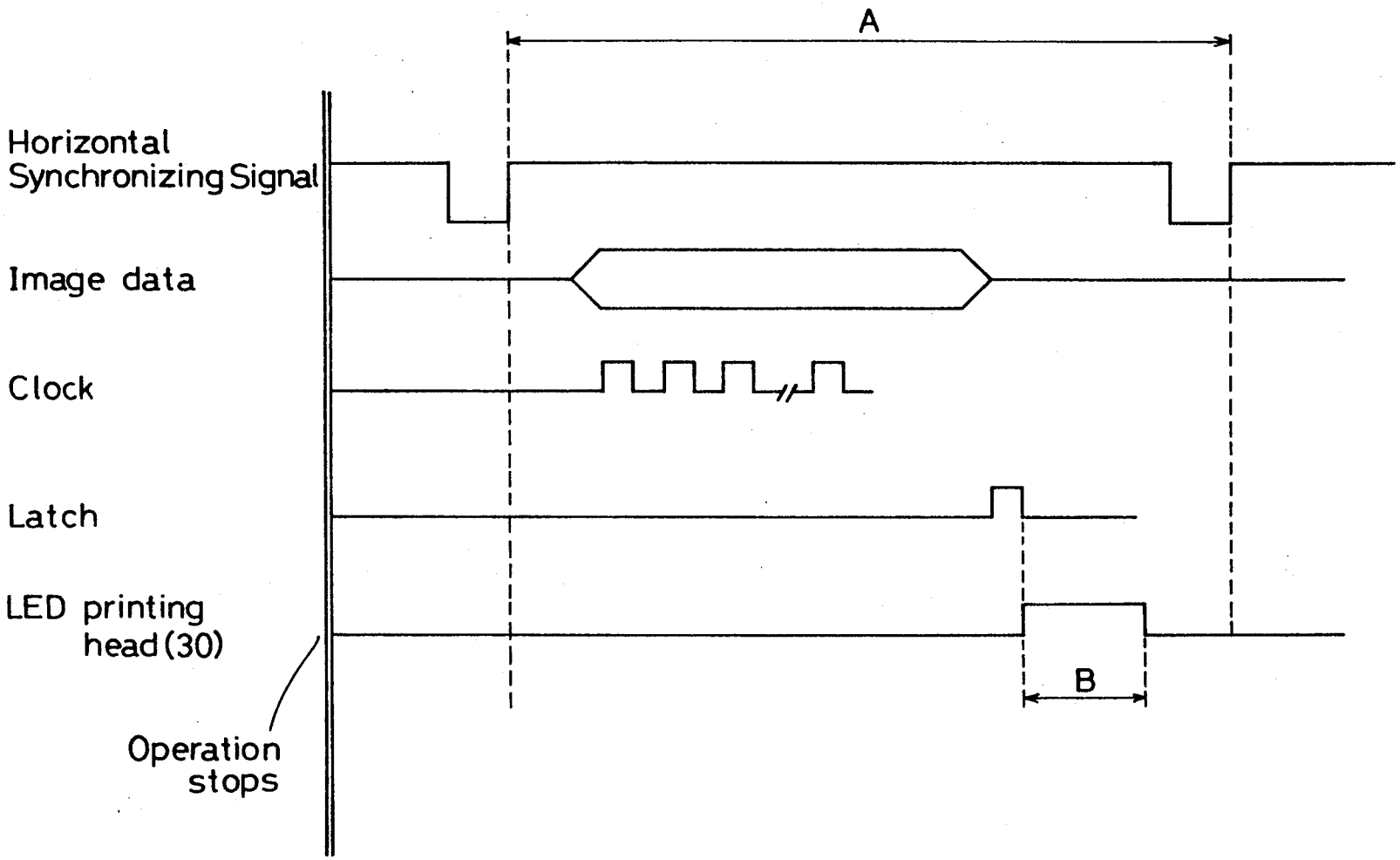
FIG. 2 is a timing chart for explaining a control operation thereof.

FIG. 1 schematically shows an embodiment of the present invention, and a timing chart of FIG. 2 shows a control operation thereof.

With a start of an image forming operation, a main motor (not shown) for activating a photoreceptor drum 10 and a main charger 20 are activated. The main charger 20 is connected to a high-voltage electric power unit H.V.U. 70*a* controlled by a CPU (central processing unit) 100. A charged portion is formed on a surface of the photoreceptor drum 10 by the main charger 20.

When a pulse voltage is applied to an LED printing head 30 based on image information by the CPU 100, light is irradiated on the charged portion formed on the photoreceptor 10 by the LED printing head 30 to form a latent image. At this time, the latent image is formed, as shown in FIG. 2, by sequentially transmitting image data by a predetermined clock from the CPU 100 to a shift register (not shown) provided in the LED printing head 30, latching the data with a latch circuit (not shown) and thereafter operating the LED printing head 30 based on the image data. A period A of a horizontal synchronizing signal shows a period of a data processing or a printing head control which corresponds to a direction along the width of a latent image.

In this embodiment, the development is the reversal development (an electrostatic development where toner adheres to a portion where an electric potential is changed by irradiating light from the LED printing head 30 on the charging portion formed on the surface of the photoreceptor 10). For example, with respect to electrophotographic copying machines, a black portion of an original corresponds to the portion, of the latent image formed on the surface of the photoreceptor drum 10, where an electric potential is changed by an irradiation of light from the LED printing head 30, that is, the portion to which toner adheres. Therefore, the more black portion the original has, the more time is required for activating the LED printing head 30 to emit light. As a result, a temperature of the LED printing head 30 remarkably increases.

The latent image formed by the LED printing head 30 is developed into a toner image by a developer unit 50 as described above. A development sleeve 60 is provided in the developer unit 50. The toner development is performed by making toner maintained on the development sleeve 60 adhere to a latent image. The development sleeve 60 is connected to a high-voltage electric power unit H.V.U. 70*b* controlled by the CPU 100. A developing bias voltage is applied to the development sleeve 60 by the high-voltage electric power 70*b*.

On the other hand, a temperature of the LED printing head 30 is measured through a temperature sensor 40, and whether or not the measured temperature exceeds a predetermined temperature is determined by the CPU 100. When it is determined by the CPU 100 that the predetermined temperature is exceeded, the CPU 100 reduces an operation duration of the LED printing head 30 and changes the developing bias voltage to be applied to the development sleeve to improve a toner density of a toner image formed by the developer unit 50.

Figure 4:
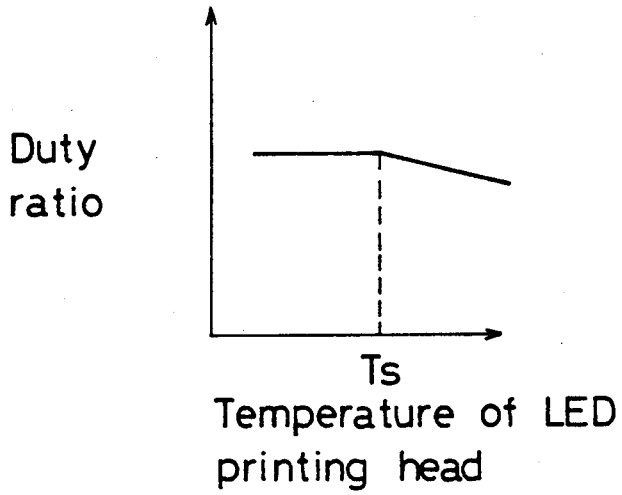
FIG. 4 is a graph showing a relation between a temperature of the LED printing head and a duty ratio.

To reduce an operation duration of the LED printing head 30 is, as shown in FIG. 2, to decrease a ratio of an operation duration B of the LED printing head 30 to the period A of the horizontal synchronizing signal, that is, a duty ratio ($B/A \times 100$). An amount of a heat generation by the LED printing head 30 can be reduced by decreasing the duty ratio. FIG. 4 shows a manner in which the duty ratio is reduced when a temperature of the LED printing head 30 exceeds a predetermined temperature $T_s$.

Figure 3:
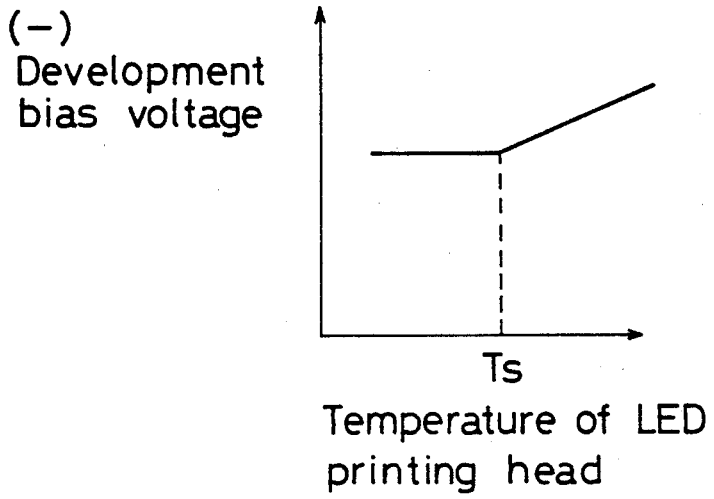
FIG. 3 is a graph showing a relation between a temperature of an LED printing head and a developing bias voltage.
Figure 5:
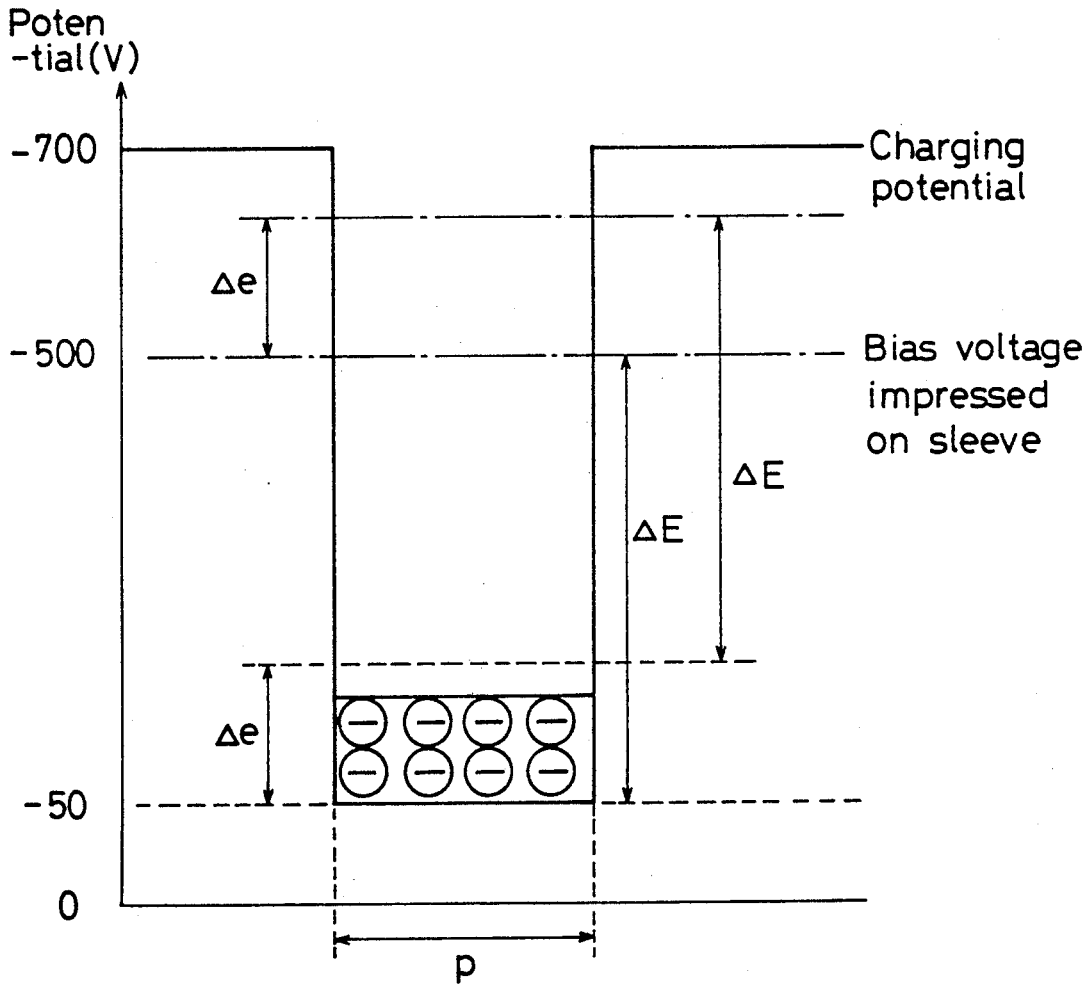
FIG. 5 shows a relation between an electric potential of a latent image on the surface of a photoreceptor and an electric potential of a development sleeve.

Moreover, to change the developing bias voltage to be applied to the development sleeve 60 in order to improve a toner density of a toner image is to change the developing bias voltage to be applied to the development sleeve toward the electric potential of the charged portion when a temperature of the LED printing head 30 increases to exceed the predetermined temperature $T_s$. In this embodiment, since the reversal development is performed, the charged portion is charged with negative electricity against toner charged with negative electricity. Therefore, when a temperature of the LED printing head 30 exceeds the predetermined temperature $T_s$ as shown in FIG. 3, the developing bias voltage increases toward negative side. FIG. 5 shows an example of a relation at this time between an electric potential of each portion of a latent image and a voltage applied to the development sleeve 60. For example, of the portions which are charged to −700 V, the electric potential of a portion P where toner is to adhere decreases to −50 V by being exposed by the LED printing head 30. Since a developing bias voltage of −500 V is applied to the development sleeve 60, the toner on the surface of the development sleeve 60 adheres to the portion P due to a potential difference $\Delta E$ of −450 V. If the emission energy of the LED printing head 30 decreases at this time, the electric potential of the portion P does not decrease to −50 V, so that the difference from the charging potential is smaller by $\Delta e$. Consequently, toner density decreases. In this embodiment, the difference $\Delta E$ is maintained by changing the developing bias voltage to be applied to the development sleeve 60 by $\Delta e$ from −500 V toward the electric potential (−700 V) of the charging portion. Toner density is controlled to be an appropriate value by changing as described above the developing bias voltage as the emission energy of the LED printing head 30 decreases.

When it is determined that the sensed temperature does not exceed the predetermined temperature, the duty ratio and the developing bias voltage are fixed as shown in FIGS. 3 and 4. Since a decrease in duty ratio leads to a decrease in emission energy of the LED printing head 30, it is preferable to previously measure a correlation among a temperature which exceeds the predetermined temperature, the duty ratio and the developing bias voltage to set an appropriate condition. The present invention can be constructed not only so that the developing bias voltage is controlled based on a predetermined temperature like this embodiment but also so that the developing bias voltage is controlled so as to continuously be changed according to a sensed temperature.

Obviously, many modifications and variations of the present invention are possible in light of the above teachings. It is therefore to be understood that within the scope of the appended claims, the invention may be practiced other than as specifically described.

What is claimed is:

1. An image forming apparatus comprising:

a photoreceptor;

charging means for forming a charged portion on said photoreceptor;

an LED printing head for forming a latent image by irradiating light on the charged portion formed on said photoreceptor based on image information, said LED printing head comprising a plurality of light emitting diodes;

developing apparatus for developing the latent image formed on said photoreceptor into a toner image;

voltage applying means for applying a developing bias voltage to said developing apparatus;

temperature sensing means for sensing a temperature of said LED printing head; and controlling means for changing a developing bias voltage applied to the developing apparatus by said voltage applying means according to a temperature of the LED printing head, sensed by said temperature sensing means so that a toner density of a toner image formed by said developing apparatus is appropriate.

2. An image forming apparatus according to claim 1, wherein the image forming apparatus is of a reversal development type where toner adheres to a latent image of a portion on which light is irradiated by said LED printing head, and said controlling means controls said voltage applying means so that said developing bias voltage changes toward an electric potential of said charged portion when a temperature of said LED printing head increases.

3. An image forming apparatus according to claim 1, wherein said controlling means changes said developing bias voltage only when a sensed temperature of said LED printing head exceeds a predetermined temperature.

4. An image forming apparatus comprising:

a photoreceptor;

charging means for forming a charged portion on said photoreceptor;

pulse voltage supplying means;

an LED printing head for forming a latent image by irradiating light on the charged portion formed on said photoreceptor when a pulse voltage is applied, said LED printing head comprising a plurality of light emitting diodes;

a developing apparatus for developing the latent image formed on said photoreceptor into a toner image;

voltage applying means for applying a developing bias voltage to said developing apparatus;

temperature sensing means for sensing a temperature of said LED printing head; and controlling means for changing a developing bias voltage applied to the developing apparatus by said voltage applying means so that an operation duration of said LED printing head decreases and a toner density of the toner image formed by said developing apparatus improves when a temperature of the LED printing head sensed by said temperature sensing means exceeds a predetermined temperature.

5. An image forming apparatus according to claim 4, wherein the image forming apparatus is of a reversal development type where toner adheres to a latent image of a portion on which light is irradiated by said LED printing head, and said controlling means controls said voltage applying means so that said developing bias voltage changes toward an electric potential of said charged portion when a temperature of said LED printing head increases.

6. An image forming apparatus according to claim 4, wherein said controlling means changes said developing bias voltage only when a sensed temperature of said LED printing head exceeds the predetermined temperature.

* * * * *